US011110627B2

(12) United States Patent
Metten

(10) Patent No.: US 11,110,627 B2
(45) Date of Patent: Sep. 7, 2021

(54) DEVICE AND METHOD FOR PROCESSING CONCRETE BLOCKS

(71) Applicant: METTEN Stein+Design GmbH & Co. KG, Overath (DE)

(72) Inventor: Michael Metten, Bergisch Gladbach (DE)

(73) Assignee: METTEN Stein+Design GmbH & Co. KG, Overath (DE)

( * ) Notice: Subject to any disclaimer, the term of this patent is extended or adjusted under 35 U.S.C. 154(b) by 222 days.

(21) Appl. No.: 15/164,158

(22) Filed: May 25, 2016

(65) Prior Publication Data

US 2016/0346955 A1 Dec. 1, 2016

(30) Foreign Application Priority Data

May 26, 2015 (DE) ..... 10 2015 108 257.8

(51) Int. Cl.
*B28B 11/08* (2006.01)
*B28B 11/18* (2006.01)

(52) U.S. Cl.
CPC ..... *B28B 11/18* (2013.01); *B28B 11/0818* (2013.01)

(58) Field of Classification Search
CPC ... B28B 11/18; B28B 11/0818; B28B 11/245; B28B 11/22; B28B 11/089; Y10S 264/66; B28D 1/006
See application file for complete search history.

(56) References Cited

U.S. PATENT DOCUMENTS 3,213,510 A * 10/1965 Mizer ..... B28B 11/18 425/335
4,147,491 A * 4/1979 Postell, Jr. ..... B28D 1/26 425/297
4,187,588 A * 2/1980 Tsukumo ..... D01H 5/565 19/281
5,133,915 A * 7/1992 Metten ..... B28B 11/0818 264/162
5,380,099 A * 1/1995 Teramachi ..... F16C 29/005 384/45
6,331,105 B1 12/2001 Lee
7,674,155 B2 3/2010 Gebhart et al.
2007/0234679 A1* 10/2007 Metten ..... B28B 1/005 52/741.1

(Continued)

FOREIGN PATENT DOCUMENTS

DE 3741618 A1 6/1989
DE 3814148 A1 11/1989
DE 3918271 A1 12/1990

(Continued)

*Primary Examiner* — James P Mackey
(74) *Attorney, Agent, or Firm* — The Webb Law Firm

(57) ABSTRACT

A device (1, 1') is depicted and described for processing concrete blocks (2), including: a transport device (3) for the transport of concrete blocks (2), and means (4, 4') for the mechanical processing of the edges of the concrete blocks (2), wherein the means (4, 4') for the mechanical processing are arranged above the transport device (3). In order to be able to process the concrete blocks (2) in a constructively simple manner with low mechanical stress, it is proposed, to pivot-mount the means (4, 4') for the mechanical processing. In addition, a method for processing concrete blocks (2) is depicted and described.

8 Claims, 5 Drawing Sheets

(56) References Cited

U.S. PATENT DOCUMENTS

2008/0006971 A1* 1/2008 Kawai ..... B24B 9/06
264/630

FOREIGN PATENT DOCUMENTS

| | | | |
|---|---|---|---|
| DE | 3927601 | A1 | 3/1991 |
| DE | 10361732 | A1 | 7/2005 |
| DE | 102005005300 | A1 | 6/2006 |
| DE | 102005056163 | A1 | 12/2006 |
| DE | 102006059205 | A1 | 6/2007 |
| DE | 102008044745 | A1 | 12/2009 |
| EP | 1211036 | A1 | 6/2002 |

* cited by examiner

DEVICE AND METHOD FOR PROCESSING CONCRETE BLOCKS

CROSS-REFERENCE TO RELATED APPLICATION

This application claims priority to German Patent Application No. 10 2015 108 257.8 filed May 26, 2015, the disclosure of which is hereby incorporated in its entirety by reference.

BACKGROUND OF THE INVENTION

Field of the Invention

The invention relates to a device for processing concrete blocks, comprising: a transport device for the transport of the concrete blocks, and means for the mechanical processing of the edges of the concrete blocks, wherein the means for the mechanical processing are arranged above the transport device.

The invention relates also to a method for the processing of concrete blocks comprising the following steps: a) moulding the concrete blocks, b) mechanical processing of the edges of the concrete blocks on at least one side of the concrete blocks, and c) curing the concrete blocks.

Description of Related Art

In contrast to natural stones, concrete blocks are artificially produced stones. Sand, gravel, cement, water and natural stone chippings are frequently used as materials for the production of concrete blocks. In the production of concrete blocks the material mixture still wet at this time is given in a mould and cured after the demoulding. Depending on the material mixture and mould used concrete blocks can be produced with a wide range of shapes, colours and surface structures.

However, after the demoulding, the concrete blocks frequently do not yet have the desired properties, which makes a reworking of the concrete blocks necessary. For example, the reworking can consist of removing sharp-edged burrs present on the edges of the concrete blocks. On the one hand, this has the purpose of reducing the risk of injury and, on the other hand, is used for aesthetic reasons. In order to achieve the effect of an artificial ageing, frequently not only the burrs are removed, but rather even more material is removed from the edges of the concrete blocks.

A method known from the prior art for processing the edges of concrete blocks is the so-called "rumbling method" or "grinding method", in which the cured concrete blocks are loaded into a rotating drum, wherein the edges of the concrete blocks chip as a result of the collisions between the concrete blocks. This method has the disadvantage of a high apparatus expense; moreover, due to the high mechanical stresses, only already completely cured concrete blocks can be processed in this way.

A device and a method for the artificial ageing of concrete blocks is known from DE 38 14 148 A1. It is proposed for the processing of concrete blocks to provide a hammer device at the concrete block production plant. The hammer device is arranged above the transport track, on which the concrete blocks are transported and can be moved along with the concrete blocks. The hammer device comprises several hammering tools with hitting surfaces. The hammering tools can be moved up and down in the vertical direction and thus impact or hammer on the concrete blocks. Concrete is supposed to break off in the area of the edges of the concrete blocks due to the striking of the hammering tools on the top of the concrete blocks.

The solution known from DE 38 14 148 A1 has several disadvantages. One disadvantage lies in the very high mechanical stress of the concrete blocks. For this reason the hammer device can be used only in the "dry concrete area"—i.e. after exit of the concrete blocks from the drying chamber—and not in the "wet concrete area," since the concrete blocks in the wet concrete area are still rather soft and would be crushed by the hammering tools. Also, the strong vibrations represent a challenge and make the securing of the concrete blocks by a holding device required. A further disadvantage lies in the high design expense of the plant, since the hammer device must be mounted in such a way that it can be moved in the direction of transport of the concrete blocks and transverse to the direction of transport of the concrete blocks. Also, the high dust emissions typical for a processing in the "dry concrete area" represent a disadvantage of this solution.

Against this background the problem addressed by the invention is to design and develop the device mentioned at the outset and depicted previously in detail as well as the method mentioned at the outset and depicted previously in detail such that the concrete blocks can be processed with low mechanical stress in a constructively simple manner.

SUMMARY OF THE INVENTION

This problem is solved with a device wherein the means for the mechanical processing are pivot-mounted.

The device according to the present invention serves for the processing, for example, of cuboid-shaped concrete blocks and in particular for the processing of edges on the top ("visible side") of the concrete blocks. The term concrete block—in distinction from a natural stone—is understood to mean an artificially produced stone, which can, for example, contain sand, gravel, cement, water and natural stone chippings. The term concrete blocks is understood to mean concrete slabs as well as concrete bricks or concrete steps. Concrete blocks can be designed single-layered, double-layered or multi-layered. The concrete blocks can have burrs on their edges to be processed, which stick out preferably at least 1 mm, in particular at least 2 mm from the concrete blocks. To begin with, the device comprises a transport device for transporting the concrete blocks. The transport device can, for example, be a transport belt or another suitable conveyor. The transport device is preferably arranged in a horizontal plane. Moreover, the device comprises means for the mechanical processing of the edges of the concrete blocks. The term mechanical processing can be understood to mean in particular a contacting processing. The means for the mechanical processing are arranged above the transport device. This makes it possible to feed concrete blocks lying on the transport device through below the preferably stationarily arranged means for the processing, so that the edges on the top of the concrete blocks can be processed.

According to the present invention it is provided that the means for the mechanical processing are pivot-mounted. A pivotable mounting has the advantage that the means for the mechanical processing can be mounted in a stationary manner—although movable in the vertical direction—and do not need to be moved along with the concrete blocks. Instead, the means for the mechanical processing can unroll due to the pivotable mounting on the moving-along concrete blocks and thereby process their edges. The means for the mechanical processing are therefore preferably movably mounted in the vertical direction, however, mounted immovably in the horizontal direction (thus in the direction of transport).

Such a mounting has several advantages. One advantage of the pivotable mounting lies in the fact that through an unrolling movement a substantially lower and more uniform load of the concrete blocks can be achieved than in the case of an impact-type hammering movement. In this way the concrete blocks can already be processed in the wet concrete area, therefore are processed before the complete curing and preferably even before the coating of the concrete blocks. A processing of the edges before the coating of the concrete blocks has the substantial advantage that the (protective) coating of the concrete blocks takes place gapless and is not lost again through a subsequent processing in the area of the rolled or chipped edges. A further advantage of the pivotable mounting lies in the fact that the edges of the concrete blocks can be continuously moved along during the processing of their edges. This permits a problem-free integration of the device into the entire plant for the production of the concrete blocks without a lost in production output.

One embodiment of the device provides that the means for the mechanical processing are designed as rollers. Rollers have the advantage that they can roll out with their full circumference on the concrete blocks to be processed. Moreover, due to their rotation-symmetrical shape they have a defined axis of rotation and can therefore be mounted particularly simply. For example, the roller can be guided on one side or on both sides. The axis of rotation of the roller can run parallel to the plane of the transport device or be inclined relative to this plane. Preferably, the rollers are mounted in such a way that a gap arises between the roller and the transport device, the height of which is somewhat lower than the height of the concrete blocks to be processed. The undersize is preferably in the range between 1 mm and 5 mm, in particular between 2 mm and 4 mm. Particularly good results were achieved with rollers, the weight of which is between 1000 grams and 4000 grams, since the contact pressure arising hereby is in an optimal range.

With regard to this embodiment it is further proposed that the rollers are formed cylindrically or conically. The cylindrical form has the advantage that the pressure of the roller is spread uniformly on the still soft concrete block, so that the flat surface is maintained. Surprisingly, it has turned out that the edges of the concrete blocks also chip with cylindrical rollers in the desired manner, since during the removal of the burrs regularly not only the burrs themselves, but rather a little more material is detached from the concrete blocks. A further advantage of cylindrical rollers lies in the fact that with one roller several edges of the same concrete blocks or even the edges of several concrete blocks with the same height can be simultaneously processed. Moreover, with cylindrical rollers both edges can be processed, which run transverse to the axis of rotation of the roller, as well as edges, which run parallel to the axis of rotation of the roller. On the other hand, the conical or cone shell-shaped design of the rollers has the advantage that a particular high amount of material can be removed from the edges and the upper surface of the concrete blocks is not affected. For example, the inclination of the shell surface of the rollers can be adapted to the desired form of the edges of the concrete blocks to be processed. In the case of conical rollers or cone shell-shaped rollers preferably a separate roller is assigned to each edge to be processed.

With regard to the design of the rollers it is further proposed that the rollers have a smooth or a structured surface. The structure of the surface of the concrete blocks thus processed can be influenced by the design of the rollers. Thus, concrete blocks with smooth surfaces can be obtained through rollers with a smooth surface and concrete blocks with structured surfaces can be obtained through rollers with a structured surface.

Furthermore, it is proposed with regard to the design of the rollers that the rollers have a surface made of plastic, metal or ceramic. A surface made of plastic has the advantage of a high elasticity, whereby the pressure is spread particularly uniformly on the concrete blocks. Surfaces made of metal, in particular from steel or aluminium, are, however, durable and permit a very precise moulding. Ceramic has a very high wear resistance.

A further embodiment of the device is haracterized by arms for the mounting of the rollers. A mounting of the rollers on arms has the advantage that the rollers are guided precisely. It can be provided that each roller is mounted on two arms, which are arranged on opposite sides of the roller. Preferably the arms extend parallel to the direction of transport of the concrete blocks, wherein a configuration is preferred as in the case of a trailing vehicle axle: The rollers should therefore be mounted, seen in the transport direction, on the back end of the arms.

A further development of this embodiment of the device is haracterized by a frame for the suspension of the arms. Through the frame the arms can—and the rollers mounted thereon—be arranged in the desired position. The frame can, for example, be produced through profiles made of metal in particular steel or aluminium. Preferably, the frame extends in the transverse direction completely over the transport device.

For this purpose, it is further proposed that the arms are connected pivotably with the frame via bearings. Through the pivotable mounting, the arms—and the rollers mounted thereon—can perform a defined movement. Preferably, the arms are connected pivotably with the frame such that the rollers can perform a movement in the vertical direction. In this way, the rollers can act from above with their own weight force on the concrete blocks and do not need to be actively pressed downward. It can be a purely linear vertical movement or a curved movement, for example, a movement along a circular path. The bearing, for example, can be a simple pivot bearing.

With regard to the connection between the arms and the frame it is further proposed that the arms are connected with the frame via spiral springs. Through the elastic properties of the spring the arms can still perform the desired movement and are led back to their starting position after a deflection. In other words, through the springs a reset effect is achieved. This has the advantage that after processing of a concrete block and the deflection associated with it the rollers mounted on the arms rapidly reoccupy a starting position defined by the pretension of the spring and thus are prepared for the processing of the next concrete block.

According to a further embodiment of the device it is finally proposed that the rollers are arranged offset on different axes of rotation. In one example of the present disclosure, one roller may be positioned upstream of another roller. In one embodiment, a second set of rollers is pivotably connected to the frame at a point upstream of the first set of rollers. Through the offset arrangement of the rollers several concrete blocks lying close to each other on the transport device can be processed by separate rollers, even though the rollers are possibly wider than the concrete blocks. This would for the most part not be possible in the case of an arrangement of all rollers on the same axis of rotation due to lack of space.

The problem described at the outset is also solved by a method for the processing of concrete blocks. The method comprises the following steps: a) moulding of the concrete blocks, b) mechanical processing of the edges of the concrete blocks on at least one side of the concrete blocks, and c) curing of the concrete blocks. The method is haracterized in that step b) occurs before step c). The previously described sequence of the steps has the consequence that the mechanical processing must occur in the wet concrete area. In this phase the concrete blocks are not yet cured and are thus especially soft. Nevertheless, a mechanical processing of the edges of the concrete blocks can also already occur in this early phase, for example, through the previously described device. A processing of the edges of the concrete blocks in the wet concrete area has the advantage, for example, of especially low dust emissions. Preferably step b) occurs less than one hour, in particular less than 30 minutes or even less than 15 minutes after step a). In other words, the processing of the edges of the concrete blocks should occur before the onset of the hardening and before the onset of the solidification of the cement.

According to a further embodiment of the method, the method is supplemented by the following step, which occurs after step b) and before step c): b2) cleaning of the concrete blocks with compressed air. Through this step it is ensured that those pieces of material, which are chipped away due to the mechanical processing of the edges of the concrete blocks, are also completely removed from the concrete blocks. Alternatively to a cleaning by compressed air a cleaning can take place by other compressed gases.

According to a further embodiment of the method, the method is supplemented by the following step, which occurs after step b) and before step c): b3) vacuum cleaning of the concrete blocks. Preferably, step b3) also occurs after step b2). It is also ensured by this step that those pieces of material, which are chipped away due to the mechanical processing of the edges of the concrete blocks, are also completely removed from the concrete blocks.

According to a further embodiment of the method, the method is supplemented by the following step, which occurs after step b) and before step c): b4) coating of the concrete blocks. Preferably, step b4) also occurs after step b2) and after step b3). Through the application of a coating (step b4) the concrete blocks should be protected and, for example, obtain dirt- and water-repellent properties. So that the coating can cover the entire surface of the concrete blocks, the application of the coating should occur after the mechanical processing (step b), since otherwise in the area of the rolled or chipped edges a coating no longer exists.

An embodiment of the method provides that the concrete blocks continuously move on in step b), in particular continuously move on in a linear direction. The continuous operation permits a problem-free integration of the method into an overall method for the production of the concrete blocks. In comparison to an intermittent operation an increased production output can also be achieved.

According to a further embodiment of the method it is provided that in step b) concrete blocks are mechanically processed, which have burrs on their edges to be processed. Preferably, the burrs stick out from the concrete blocks at least 1 mm, in particular at least 2 mm. The burrs have the advantage that due to their protruding form they are especially easily seized by the processing tools—for example rollers. Tests have shown that when the burrs are removed no only the burrs themselves, but rather a little more material chips away from the edges of the concrete blocks. In this way, the effect of an artificial ageing or an artificial wear of the edges is achieved. It can be provided that some edges or all edges have burrs on the top ("visible side") of the concrete blocks. The edges can be provided with burrs continuously or only in sections. In the latter case, in those sections of the edges, which have no burrs, chamfers are provided. In the area of the chamfers the processing tools—for example, rollers—do not act on the concrete blocks, so that no processing of the edges occurs there. Through the combination of burrs and chamfers a combination of processed edge sections and unprocessed edge sections of the concrete blocks can therefore be obtained. The burrs on the edges of the concrete blocks can, for example, be produced through a corresponding design of the die plate of the block machine.

In a further embodiment of the method it is finally proposed that the edges of the concrete blocks are processed in step b) by a device according to any one of claims 1 to 10. The previously described device is especially suitable for implementing the method in all of the embodiments presented. This is particularly because the device causes an especially low mechanical stress of the concrete blocks, which is advantageous in particular in a processing of concrete blocks, which are not yet cured.

An important basic component for concrete is cement. The cement serves above all as a binder for the additives used, such as, for example, aggregates. In the production of concrete the so-called water-binder value (w/b value) has a large influence on the properties of the product obtained. This value describes the ratio between the mass of the mixing water and the mass of the binder (usually cement) of a compressed mixture In using aggregates like slag sand, pozzolan, fly ash, limestone, coal fly ash or silica dust not only is the mass of the pure cement crucial for the mass of the binder in calculating the w/b value, but rather also the mass of these additives, which have to be added to the mass of the cement.

Depending on the water-binder value different types of concrete are obtained with different mechanical properties, especially with regard to the compressive strength of the concrete. During hardening, a typical cement can bind approximately 40% of its mass to water. This corresponds to a w/b value of 0.40. In the case of a w/b value above 0.4 more water exists in the mixture, than the cement can bind. Therefore, pores increasingly form in the concrete, whereby the compressive strength can be reduced. Furthermore the frost sensitivity increases. The lower the w/b value is, the stiffer and more poorly processable the concrete is. Moreover, in the case of low w/b values the danger exists, that the entire binder does not cure, whereby the compressive strength drops.

Concrete blocks with the following composition have proven to be especially suitable for a processing in the previously described device or by the previously described method:

- The concrete is set before the curing to a water-binder value (w/b value) of 0.3 to 0.5, in particular to a water-binder value (w/b value) of 0.31 to 0.45, in particular to a water-binder value (w/b value) of 0.35 to 0.40.
- The percentage of cement in the concrete is 15 to 25 weight percent, in particular 17.5 to 20.5 weight percent.

BRIEF DESCRIPTION OF THE DRAWINGS

The invention is explained in detail below by means of a drawing depicting only one preferred embodiment. In the drawing.

DETAILED DESCRIPTION OF THE INVENTION

Figure 1:
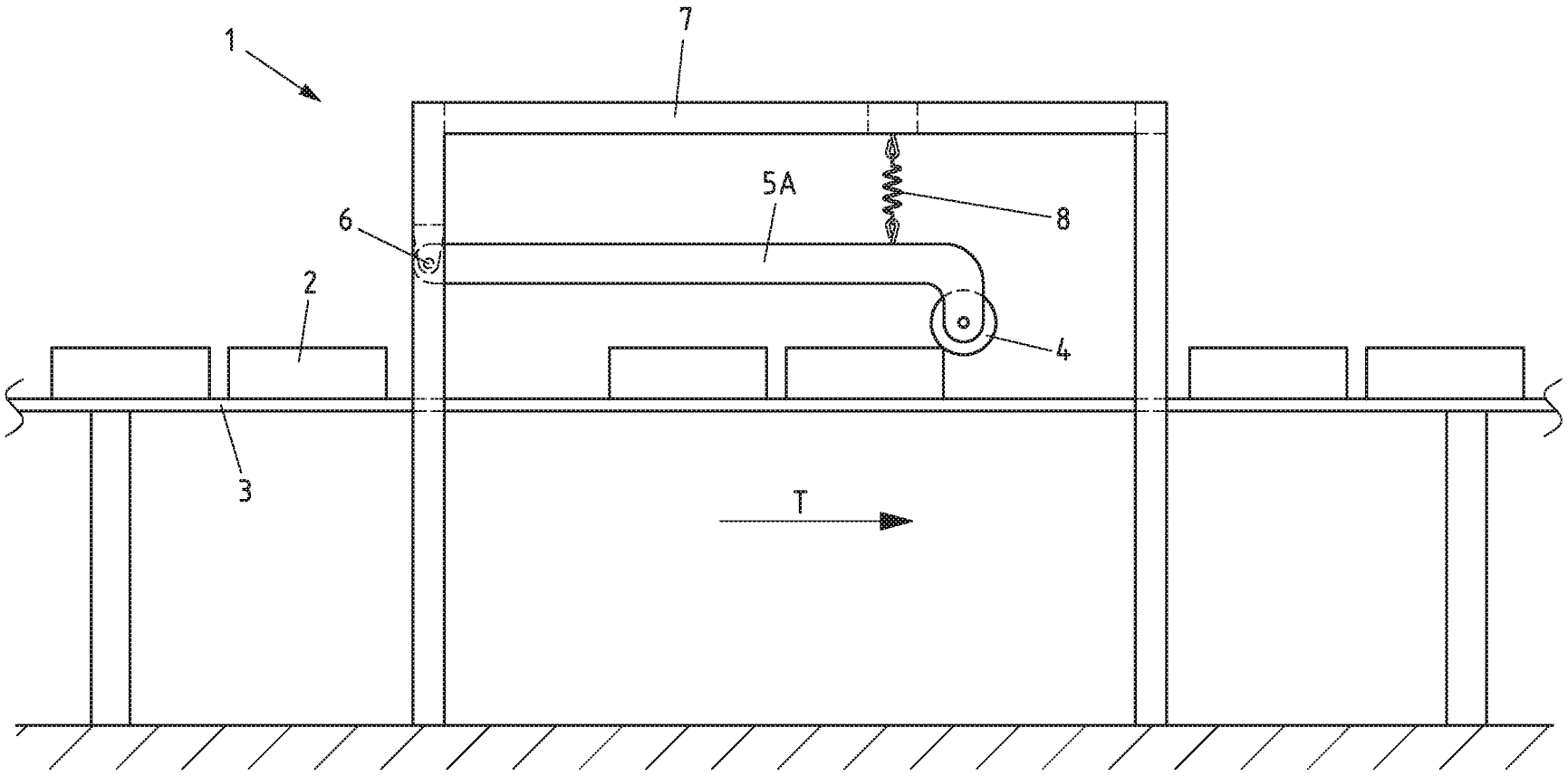
FIG. 1: shows a first embodiment of a device according to the present invention for processing concrete blocks in a side view.

FIG. 1 shows a first embodiment of a device 1 according to the present invention for processing concrete blocks 2. The device 1 comprises a device 3 for the transport of the concrete blocks 2. The transport device 3 runs in the horizontal direction and conveys the concrete blocks 2 along a direction of transport T. Moreover, the device 1 comprises means 4 for the mechanical processing of the edges of the concrete blocks 2. In the case of the device 1 depicted in FIG. 1 and preferred in this respect, the means 4 are designed as cylindrical rollers 4. The rollers 4 are arranged above the transport device and are pivot-mounted in each case on two arms 5A, 5B (arm 5B is hidden in FIG. 1). While the rollers 4 are mounted on the one end of the arms 5A, 5B, the other ends of the arms 5A, 5B are pivotably connected with a frame 7 via a bearing 6. Moreover, spiral springs 8A, 8B are provided between each arm 5A, 5B and the frame 7.

Figure 2:
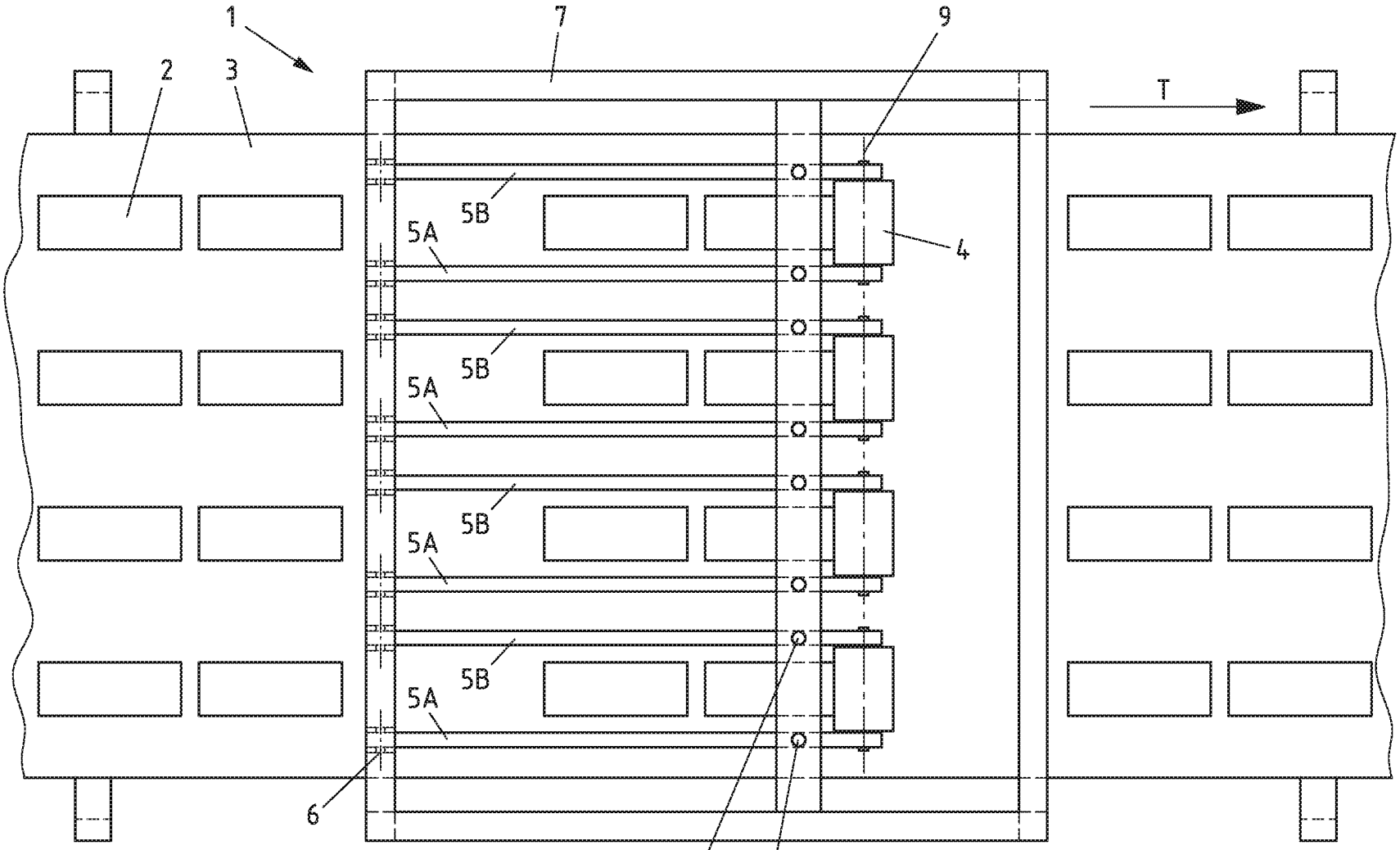
FIG. 2: shows the device from FIG. 1 in a top view.

In FIG. 2 the device 1 from FIG. 1 is shown in a top view. The areas of the device 1 already described in connection with FIG. 1 are provided in FIG. 2 with corresponding reference signs. In the top view, it can be clearly seen that four rows of concrete blocks 2 are arranged next to each other on the transport device 3 and are moved in the direction of transport T. A roller 4 is assigned to each row of concrete blocks 2. The rollers 4 are connected with the frame 7 in each case via two arms 5A, 5B running parallel. Moreover, each arm 5A, 5B is connected with the frame 7 via a spiral spring 8A, 8B. In the case of the first embodiment of the device 1 depicted in FIG. 1 and FIG. 2, all four rollers 4 are arranged on the same axis of rotation 9.

Figure 3:
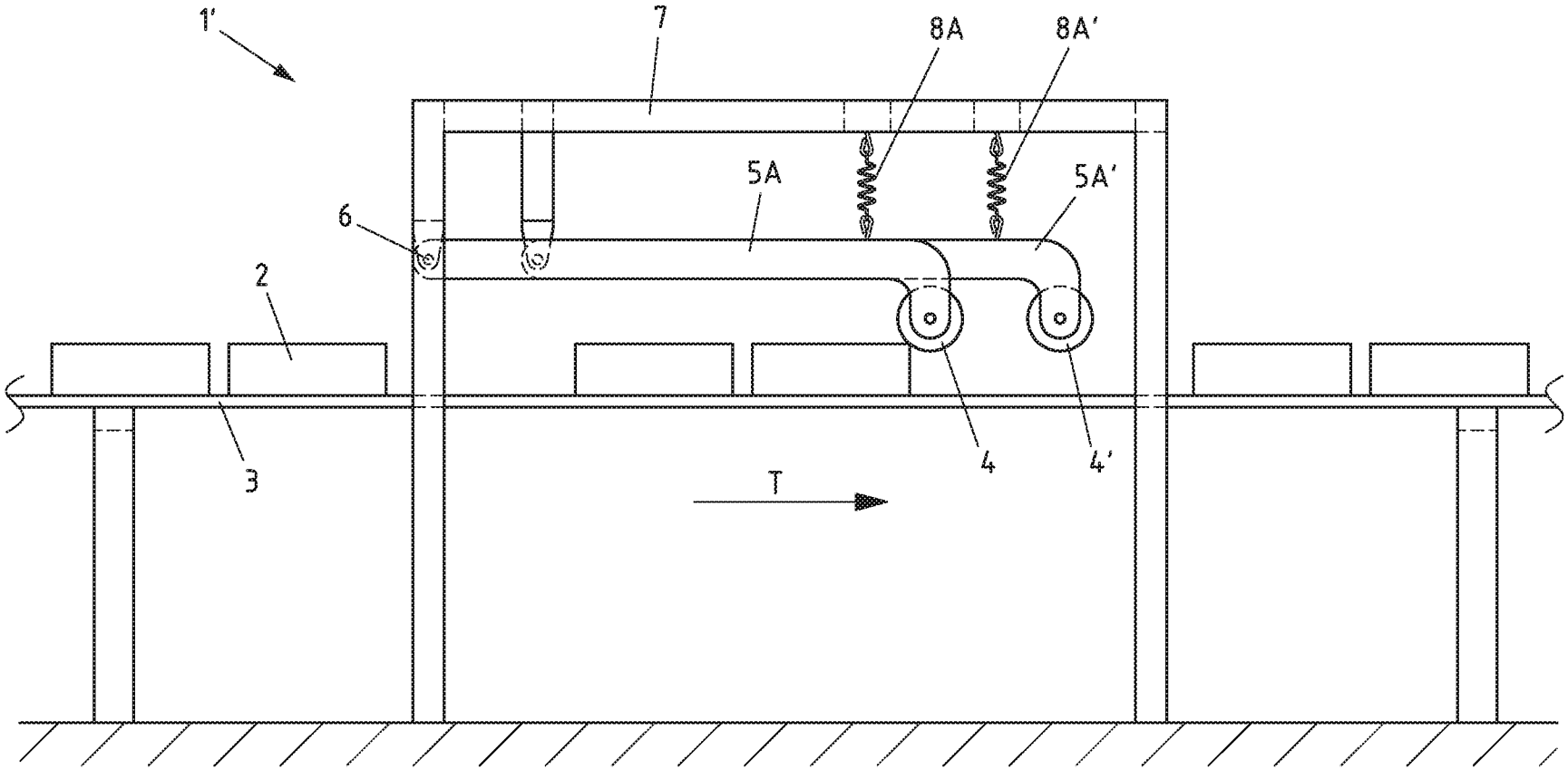
FIG. 3: shows a second embodiment of the device according to the present invention for processing concrete blocks in a side view.

FIG. 3 shows a second embodiment of a device 1' according to the present invention for processing concrete blocks 2. The areas of the device 1' already described in connection with FIG. 1 or FIG. 2 are provided in FIG. 3 with corresponding reference signs. The essential difference between the first embodiment of the device 1 and the second embodiment of the device 1' lies in the fact that the second embodiment of the device 1' has seven rollers 4, 4' and thus can simultaneously process seven rows of concrete blocks 2. Due to lack of space, the rollers 4, 4' are arranged offset in the case of the second embodiment of the device 1': four rollers 4 are arranged on a first axis of rotation 9, while three other rollers 4' are arranged on a second axis of rotation 9', which is offset relative to the first axis of rotation 9 in the direction of transport T. In the case of the embodiment of the device 1' shown in FIG. 3, the rollers 4, 4' are also mounted pivotably in each case on two arms 5A, 5B, 5A', 5B' (arms 5B, 5B' are hidden in FIG. 3). The pivotable connection of the arms 5A, 5B, 5A', 5B' to the frame 7 occurs—as was already previously described—via bearings 6 and spiral springs 8A, 8B, 8A', 8B'.

Figure 4:
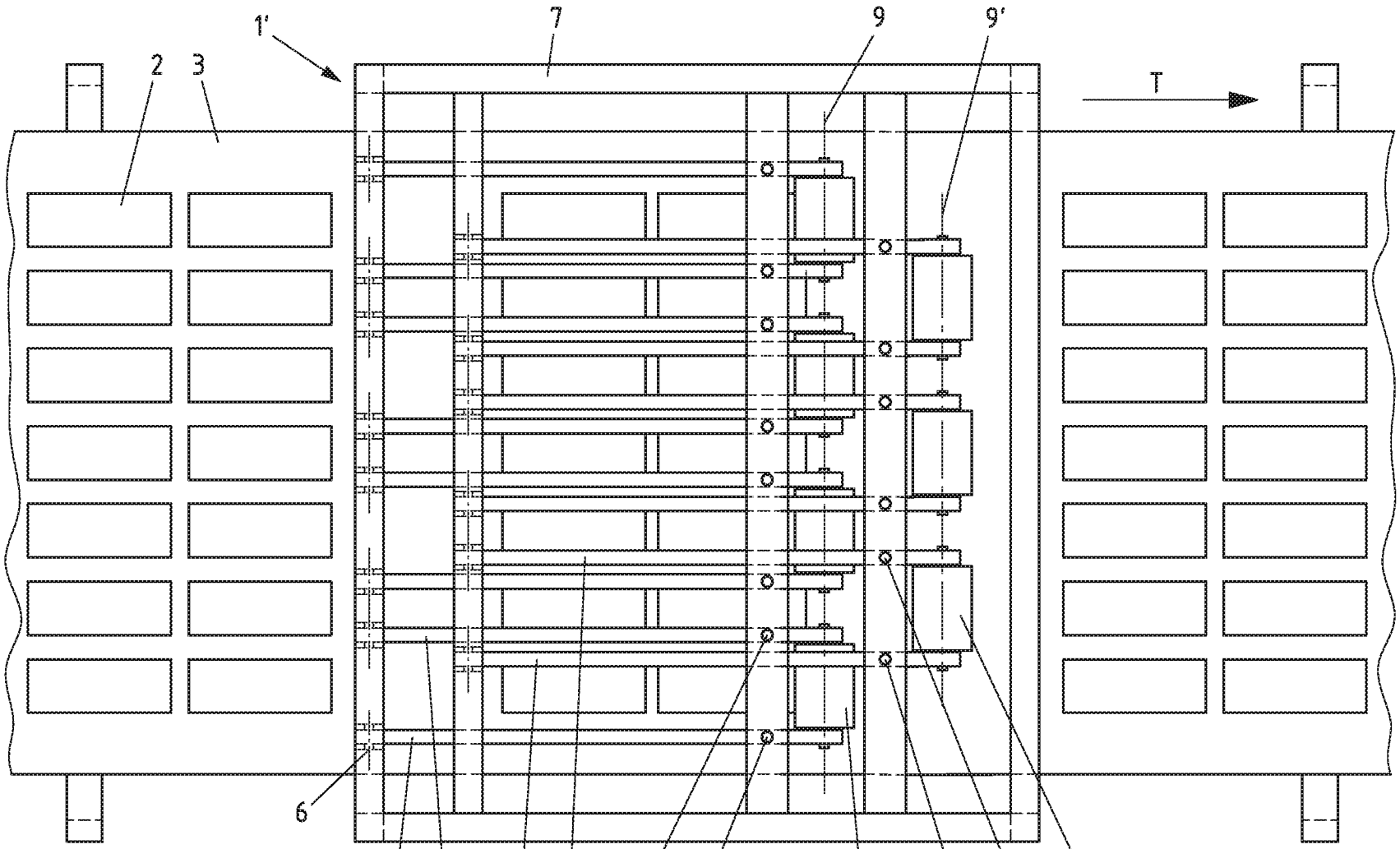
FIG. 4: shows the device from FIG. 3 in a top view.

In FIG. 4 the device 1' from FIG. 3 is shown in a top view. The areas of the devices 1, 1' already described in connection with FIG. 1 to FIG. 3 are provided in FIG. 4 with corresponding reference signs. In the top view, it can be clearly seen that seven rows of concrete blocks 2 are arranged next to each other on a transport device 3 and are moved in the direction of transport T. A roller 4, 4' is assigned to each row of concrete blocks 2. The front rollers 4 are connected with the frame 7 via the arms 5A, 5B running parallel and the back rollers 4' are connected with the frame 7 via the arms 5A', 5B' running parallel. The arms 5A, 5B of the front rollers 4 and the arms 5A', 5B' of the back rollers 4' are arranged alternately due to the overlapping position of the rollers 4, 4'. Each arm 5A, 5B, 5A', 5B' is connected with the frame 7 via a spiral spring 8A, 8B, 8A', 8B'. In the case of the second embodiment of the device 1' depicted in FIG. 3 and FIG. 4, the rollers 4, 4' are arranged on different axes of rotation 9, 9': the front four rollers 4 are arranged on the front axis of rotation 9 and the back three rollers 4 are arranged on the back axis of rotation 9'.

The devices 1, 1' shown in FIG. 1 to FIG. 4 are not specified for four or seven rollers 4, 4', but rather can be adapted to any number of rollers 4, 4'. The rollers 4, 4' can be arranged on the same axis of rotation 9 or on two or more different axes of rotation 9, 9'.

Figure 5:
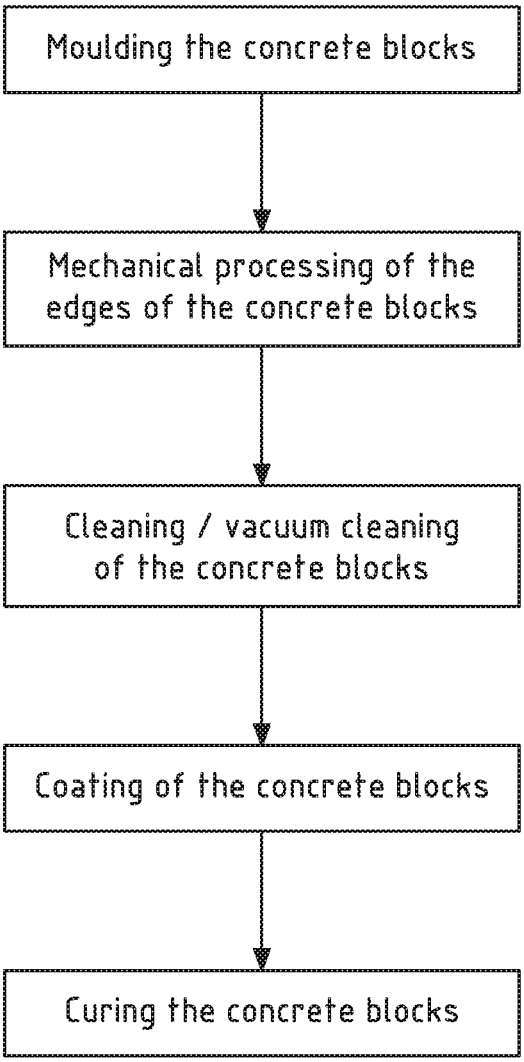
FIG. 5: shows a method for processing concrete blocks in a schematic representation.

FIG. 5 shows a method for processing concrete blocks 2 in a schematic representation. The method comprises the following steps: a) moulding the concrete blocks, b) mechanical processing of the edges of the concrete blocks, b2)/b3) cleaning/vacuum cleaning of the concrete blocks, b4) coating of the concrete blocks, c) curing the concrete blocks. The steps a), b), and c) are mandatorily required, while the steps b2), b3) and b4) are merely optional—although very advantageous.

LIST OF REFERENCE SIGNS

1, 1': device
2: concrete block
3: transport device
4, 4': means/rollers
5A, 5B, 5A', 5B': arm
6: bearing
7: frame
8A, 8B, 8A', 8B': spiral spring
9, 9': axis of rotation
T: direction of transport

The invention claimed is:

1. A device for processing concrete blocks, comprising:

a transport device for a transport of the concrete blocks, an arrangement for a mechanical processing of edges of the concrete blocks, wherein the arrangement for the mechanical processing are designed as rollers;

arms for a mounting of the rollers, wherein at least two rows of rollers are provided including a first row of rollers and a second row of rollers with the second row of rollers being positioned downstream of the first row of rollers; and a frame for suspension of the arms, wherein the arms are connected pivotably with the frame via bearings, wherein the arms are connected with the frame via springs, wherein a longitudinal axis of each of the arms extends parallel to a direction of transport of the concrete blocks, and wherein the arms of the second row of rollers are pivotably connected with the frame at a point upstream of the first row of rollers;

wherein the arrangement for the mechanical processing are arranged above the transport device, and wherein the arrangement for the mechanical processing are pivot-mounted.

2. The device according to claim 1, wherein the rollers are formed cylindrically or conically.

3. The device according to claim 1, wherein the rollers have a flat or a structured surface.

4. The device according to claim 1, wherein the rollers have a surface made of plastic, metal, or ceramic.

5. The device according to claim 1, wherein the rollers are arranged offset on different axes of rotation.

6. A method for a processing of concrete blocks, comprising the following steps:

a) moulding the concrete blocks, b) mechanical processing of edges of the concrete blocks on at least one side of the concrete blocks, b1) vacuum cleaning of the concrete blocks, c) curing the concrete blocks, and d) coating of the concrete blocks, wherein step b) occurs before step c), wherein step b1) occurs after step b) and before step c), wherein step d) occurs after step b) and before step c), wherein the mechanical processing must occur in a wet concrete area, and wherein in step b), the concrete blocks are mechanically processed, further including the step of processing burrs on the edges of the concrete blocks, and still further wherein chamfers on the blocks are not mechanically processed.

7. The method according to claim 6, wherein the concrete blocks continuously move on in step b).

8. The method according to claim 6, wherein the edges of the concrete blocks are processed in step b) by a device for processing concrete blocks, the device comprising:

a transport device for a transport of the concrete blocks, an arrangement for a mechanical processing of edges of the concrete blocks, wherein the arrangement for the mechanical processing are designed as rollers;

arms for a mounting of the rollers, wherein at least two rows of rollers are provided including a first row of rollers and a second row of rollers with the second row of rollers being positioned downstream of the first row of rollers; and a frame for suspension of the arms, wherein the arms are connected pivotably with the frame via bearings, wherein the arms are connected with the frame via springs, wherein a longitudinal axis of each of the arms extends parallel to a direction of transport of the concrete blocks, and wherein the arms of the second row of rollers are pivotably connected with the frame at a point upstream of the first row of rollers;

wherein the arrangement for the mechanical processing are arranged above the transport device, and wherein the arrangement for the mechanical processing are pivot-mounted.

* * * * *